US008196846B2

(12) United States Patent
Fahy et al.

(10) Patent No.: US 8,196,846 B2
(45) Date of Patent: Jun. 12, 2012

(54) MANIFOLD FOR AUTOMATED SPRAYER

(75) Inventors: Cathal L. Fahy, Racine, WI (US); Dana J. Koppes, Worthington, OH (US)

(73) Assignee: S.C. Johnson & Son, Inc., Racine, WI (US)

( * ) Notice: Subject to any disclaimer, the term of this patent is extended or adjusted under 35 U.S.C. 154(b) by 307 days.

(21) Appl. No.: 12/326,323

(22) Filed: Dec. 2, 2008

(65) Prior Publication Data

US 2010/0133362 A1 Jun. 3, 2010

(51) Int. Cl.
*B05B 9/04* (2006.01)

(52) U.S. Cl. ..... 239/332; 239/333; 239/263.1

(58) Field of Classification Search ..... 239/329–334, 239/110, 351, 355–363, 347–349, 124, 126, 239/127, 263.1
See application file for complete search history.

(56) References Cited

U.S. PATENT DOCUMENTS

| | | | | |
|---|---|---|---|---|
| 2,749,179 | A * | 6/1956 | Almquist | 239/215 |
| 3,078,471 | A * | 2/1963 | Knibb | 4/517 |
| 3,386,472 | A | 6/1968 | Szonntagh | |
| 3,584,640 | A * | 6/1971 | Chapman | 137/209 |
| 5,014,884 | A * | 5/1991 | Wunsch | 222/333 |
| 5,251,670 | A | 10/1993 | Bates | |
| 5,399,089 | A | 3/1995 | Eichman et al. | |
| 5,577,638 | A | 11/1996 | Takagawa | |
| 5,803,940 | A | 9/1998 | Rick et al. | |
| 5,832,956 | A | 11/1998 | Nimberger | |
| 5,853,572 | A | 12/1998 | Kuennen et al. | |
| 5,980,741 | A | 11/1999 | Schnell et al. | |
| 6,142,750 | A | 11/2000 | Benecke | |
| 6,811,691 | B2 | 11/2004 | Woodard, Jr. et al. | |
| 7,021,494 | B2 * | 4/2006 | Mazooji et al. | 222/83 |
| 7,025,080 | B2 | 4/2006 | Wass et al. | |
| 7,166,216 | B2 | 1/2007 | Woodard, Jr. et al. | |
| 7,246,755 | B2 * | 7/2007 | Hornsby et al. | 222/153.13 |
| 2002/0148908 | A1 | 10/2002 | Linstedt et al. | |
| 2003/0019803 | A1 | 1/2003 | Woodard, Jr. et al. | |
| 2006/0021926 | A1 | 2/2006 | Woodard, Jr. et al. | |

FOREIGN PATENT DOCUMENTS

WO 2009/126283 A1 10/2009

OTHER PUBLICATIONS

International Search Report and Written Opinion dated Feb. 4, 2010 Appl. No. PCT/US2009/006336.

* cited by examiner

*Primary Examiner* — Christopher Kim

(57) ABSTRACT

Disclosed are manifold assemblies for use in automated sprayers. The manifold assemblies provide passageways for cleaning fluid, venting air if venting is needed, and drainage fluid. They also provide a mount for a motor and a pump chamber. There are also check valves retained in the manifold assemblies to ensure that the flows are in the proper direction.

4 Claims, 9 Drawing Sheets

MANIFOLD FOR AUTOMATED SPRAYER

CROSS-REFERENCE TO RELATED APPLICATIONS

Not applicable.

STATEMENT OF FEDERALLY SPONSORED RESEARCH OR DEVELOPMENT

Not applicable.

BACKGROUND OF THE INVENTION

This invention relates to an apparatus for automatically spraying an area such as a bath or shower enclosure. More particularly, it relates to manifold structures for use therewith.

There are a number of devices that have been developed for spraying an area. For example, U.S. Pat. No. 7,021,494 describes a device for spraying the walls and doors of bath and shower enclosures with a cleaning solution in an automated fashion. This device incorporates a pump for extracting liquid from a storage reservoir and ejecting it through a nozzle housed in a rotating turret.

Various tubing and connections are required to mount and link the pump to its source and outlet, permit appropriate air venting, avoid unwanted backflow, accommodate the motor and pump, and link to a nozzle rotating system. All of this must be achieved while avoiding leakage of water into the device from the surrounding shower environment and other fluid leaks at the various internal connections. Requiring numerous parts that must be separately formed and assembled can increase the costs associated with the device, especially from the standpoint of increasing manufacturing costs of the components, labor costs relating to assembling the device, and quality control costs (e.g., checking for leakage at the joints between the parts).

In U.S. Pat. No. 5,577,638 there was disclosed a bottom pouring pot reservoir whose outflow and venting were controlled by a housing that accommodated some of the valving. While this approach addressed some of the above issues, it still was somewhat complicated (and thus costly) to manufacture, and further did not accommodate a motor or pumping apparatus (as distinguished from just using gravity flow).

U.S. Pat. No. 3,386,472 showed the use of one type of clamshell construction for accommodating various inlets and valving for use in a gas chromatography context. However, again, there was no teaching of how to accommodate a motor or pumping apparatus.

Accordingly, there still exists a need in the art for an improved assembly structure for internal portions of an automated sprayer that incorporates a motor or pumping apparatus.

SUMMARY OF THE INVENTION

The invention provides a manifold assembly suitable for use in an automated sprayer. This type of sprayer delivers fluid (e.g. a cleaning fluid) from a reservoir to a spray nozzle.

The manifold assembly has a housing having a fluid inlet passage, a fluid outlet passage, and a motor supported by the housing and being suitable to be operatively linked to a pump. In the most preferred form, the housing also has an air inlet and an air outlet.

In other embodiments the housing can have a stand for supporting the motor, there can be a pump mounted in the manifold assembly linked to both the fluid inlet passage and fluid outlet passage, the pump can be operatively linked to the motor, and there can be a check valve positioned in the manifold assembly.

Hence, a single manifold assembly can provide a centralized unitary structure for linking the key operational components of such a sprayer. Further, in some sprayers it is desirable to provide an additional drainage passage for fluid that may accumulate near the reservoir. If so, the unitary structure can also accommodate that. A drainage passageway can be provided for carrying drainage fluid through the manifold assembly without passing through the fluid inlet passage or fluid outlet passage.

In other forms, the housing can have a first housing part and a second housing part that have been coupled together. Also, there can be a gasket sandwiched between the first housing part and the second housing part, and a pump chamber integrally formed in at least one of the first housing part and the second housing part.

Various means may be used to link the housing parts. For example, they could be welded together by induction welding and/or ultrasonic welding. Alternatively, they could be screwed or bolted together, or clipped together.

Various embodiments of the invention provide varied important advantages. For example, they reduce the number of parts required to achieve the functions of an automated sprayer, they reduce assembly costs and complexity, they reduce the risk of leaks, and they provide the opportunity to use more compact designs.

These and other advantages of various embodiments of the present invention will be apparent from the discussion below and the drawings. Of course, the following are merely the preferred embodiments. The claims should be looked to in order to more fully appreciate the scope of the invention.

DETAILED DESCRIPTION OF THE PREFERRED EMBODIMENTS

Figure 1:
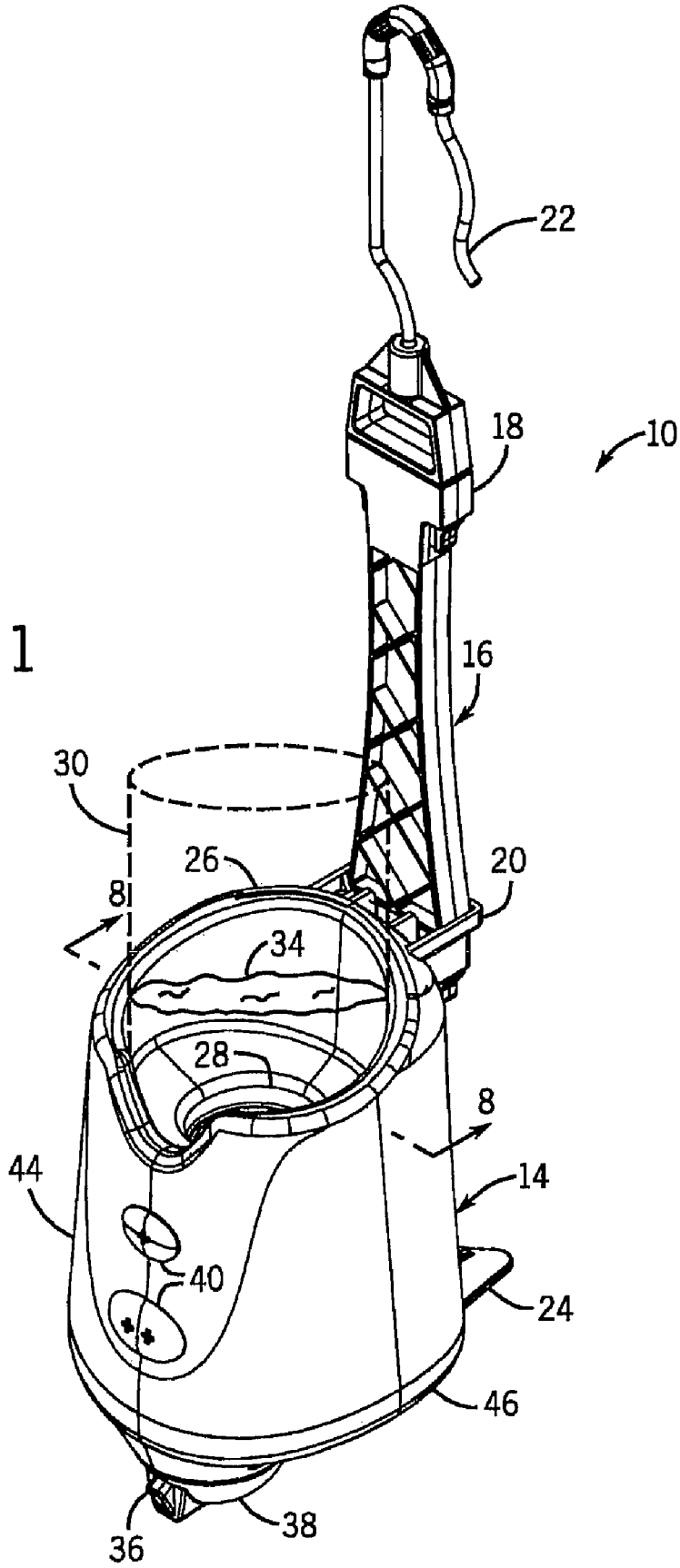
FIG. 1 is a front, right perspective view of an automated sprayer incorporating the present invention.
Figure 2:
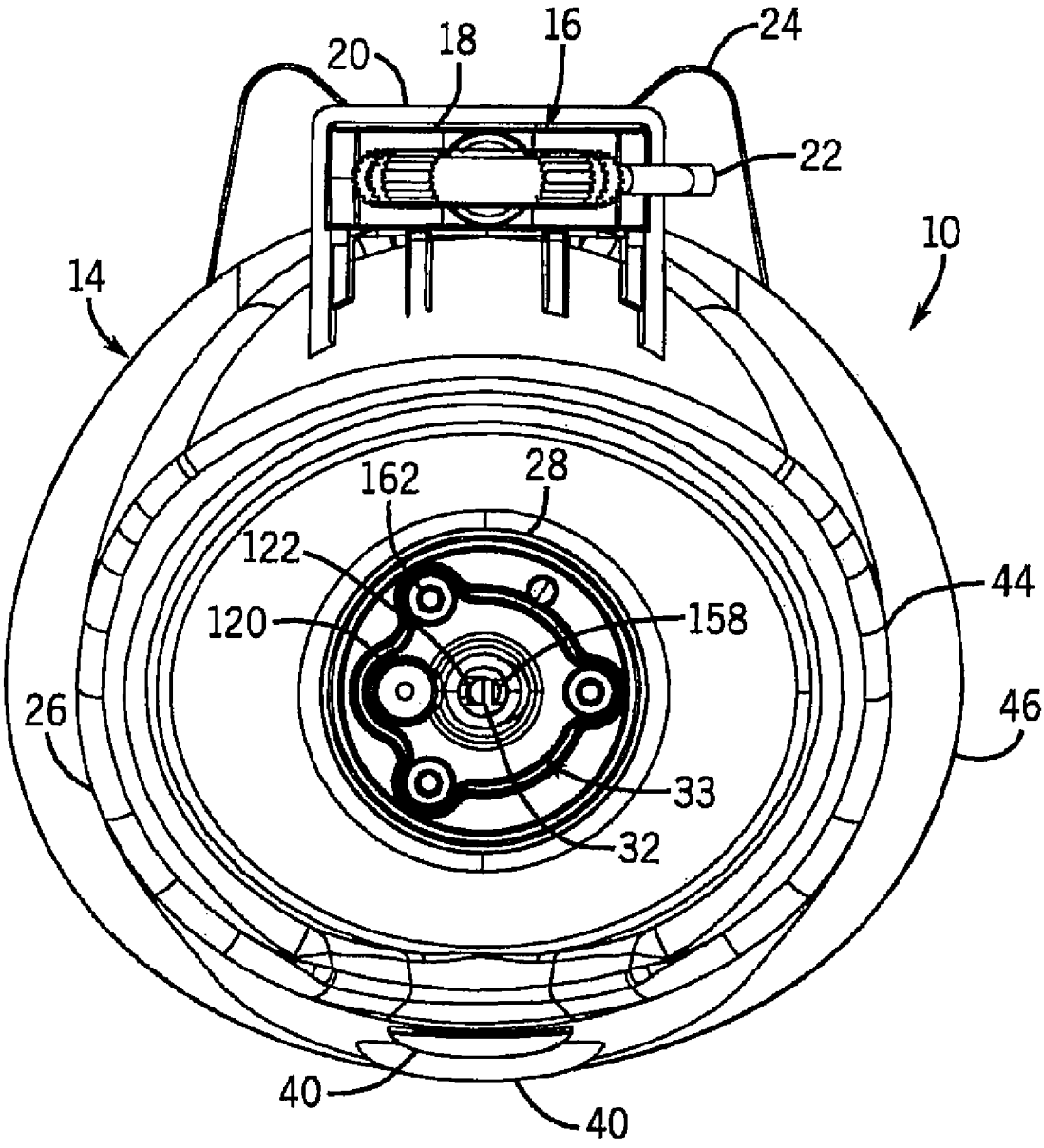
FIG. 2 is a top view thereof.
Figure 3:
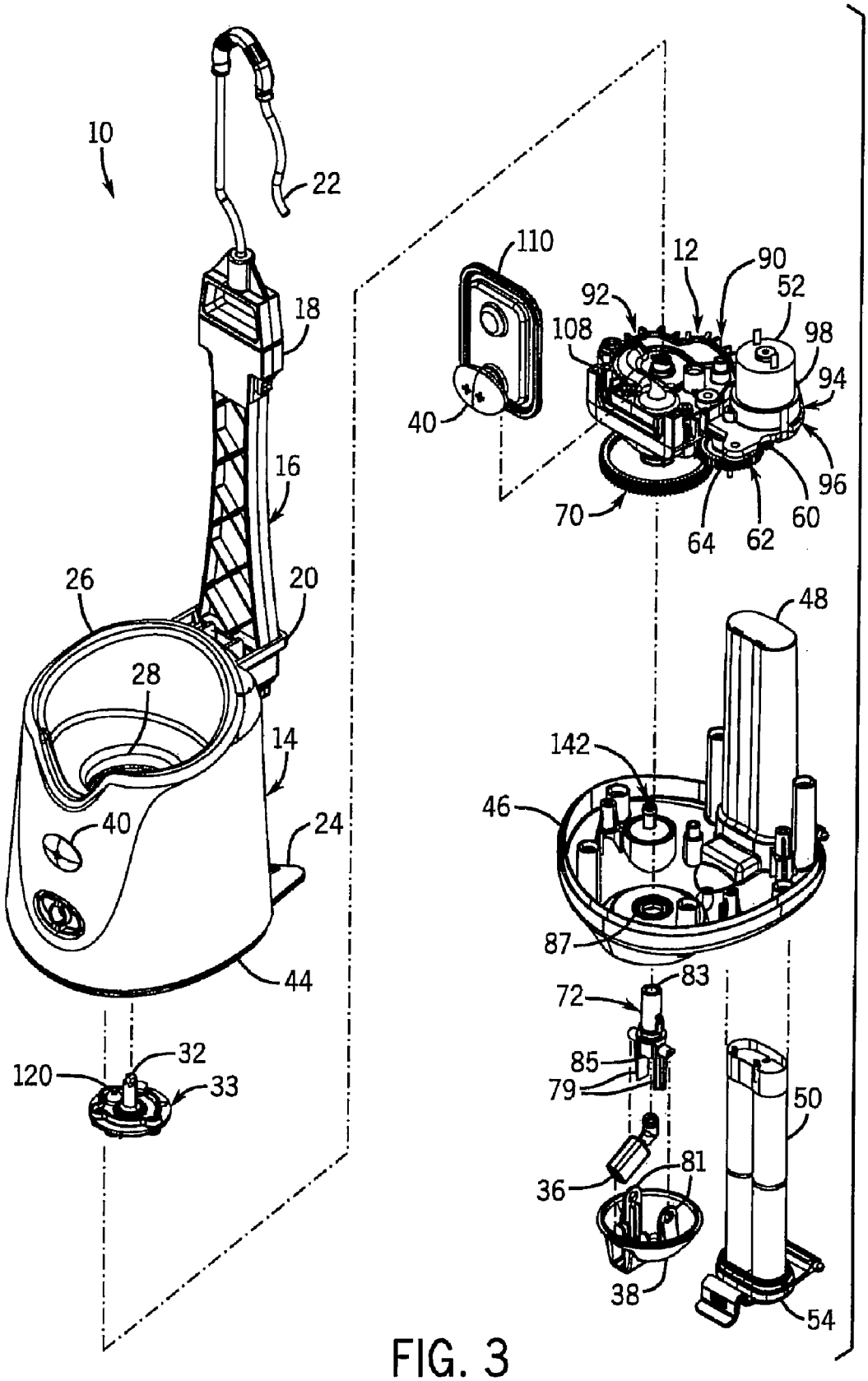
FIG. 3 is a partially exploded view thereof.

Turning first to FIGS. 1-3, there is shown an automated sprayer 10 having a manifold 12. The manifold facilitates the delivery of a cleaning fluid from a reservoir to a nozzle sprayer.

Apart from the manifold feature, much of the preferred automated sprayer 10 is similar to a sprayer of U.S. Pat. No. 7,021,494, which is hereby incorporated by reference as if fully set forth herein.

The automated sprayer 10 includes a body 14 coupled to a hanger 16. While the hanger 16 could take many forms, here it is shown as having a support 18 secured to a bracket 20 extending from the sprayer body 14. There is also a curved hook 22 formed at the upper end of the hanger 16 to allow the automated sprayer 10. In any event, the purpose of the hanger is to secure the sprayer on a shower pipe or the like (not shown). In one form there can be a sprayer leg 24 protruding backward from the sprayer body 14 to rest against the shower enclosure and to thereby provide the automated sprayer 10 additional stability during operation.

Figure 8:
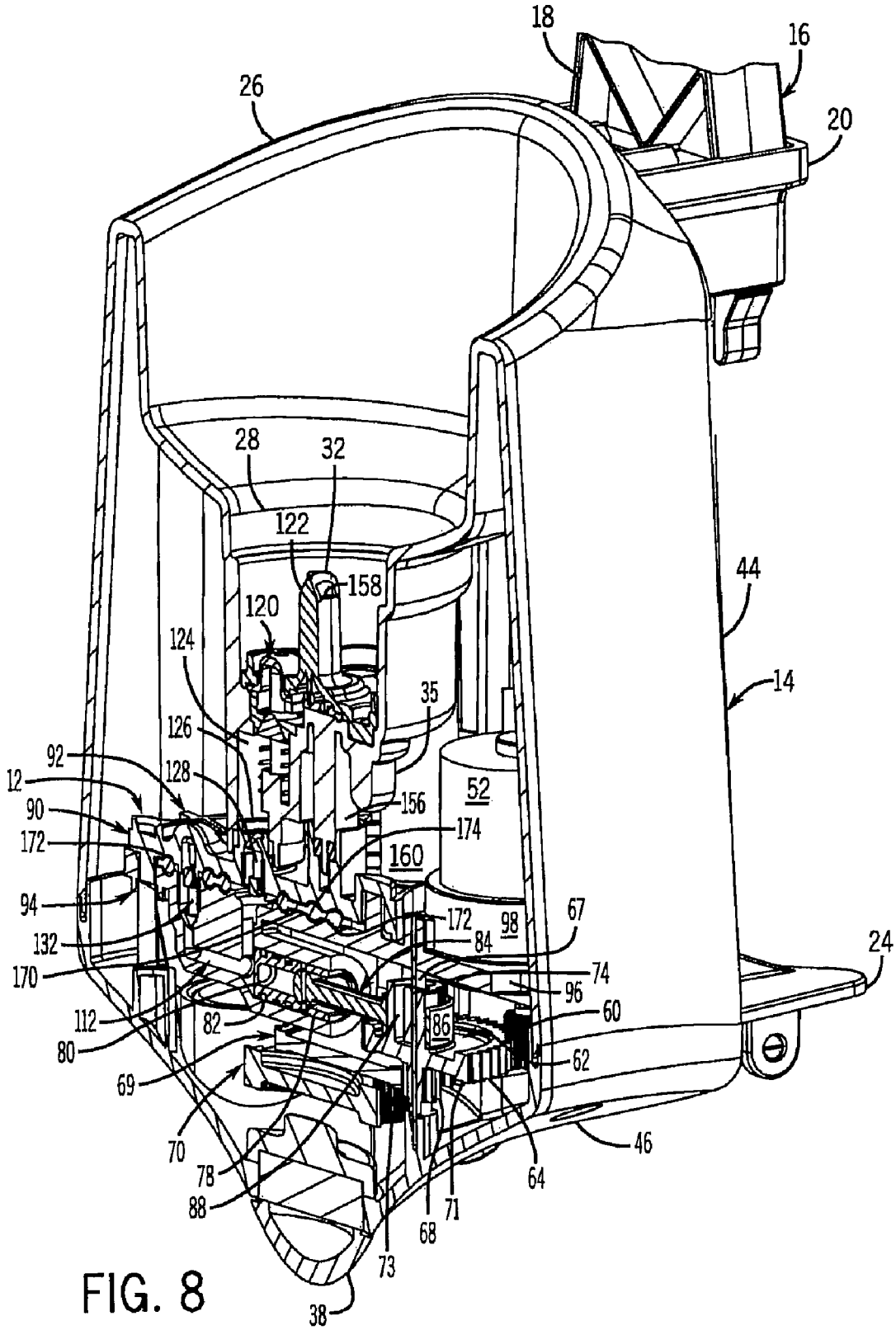
FIG. 8 is a sectional view taken along line 8-8 of FIG. 1.

The sprayer body 14 includes an upper sprayer body 44 and a lower sprayer body 46 that combine to form the overall sprayer body 14. The upper sprayer body 44 includes an upper flange 26 that defines a well 28. A fluid reservoir 30, for example a bottle, (shown in dashed lines in FIG. 1) is inverted and placed into the well 28. As seen in FIGS. 1, 2 and 8, a piercing post 32 extends up from a reservoir interface assembly 33, enters the fluid reservoir 30, and ultimately directs a cleaning fluid 34 to the bottom nozzle 36. The nozzle 36 is housed in a rotating turret 38 that extends from the base of the sprayer body 14. The nozzle assembly may be as shown, or may have other single-piece or multi-piece structures.

The automated sprayer 10 is activated and adjusted via buttons 40 protruding from the front of the sprayer body 14. For example, the automated sprayer 10 can provide a warning chime and then, after a time delay, expel fluid 34 from the nozzle 36 as the turret 38 rotates for a pre-determined, or user selected, amount of time.

Figure 4:
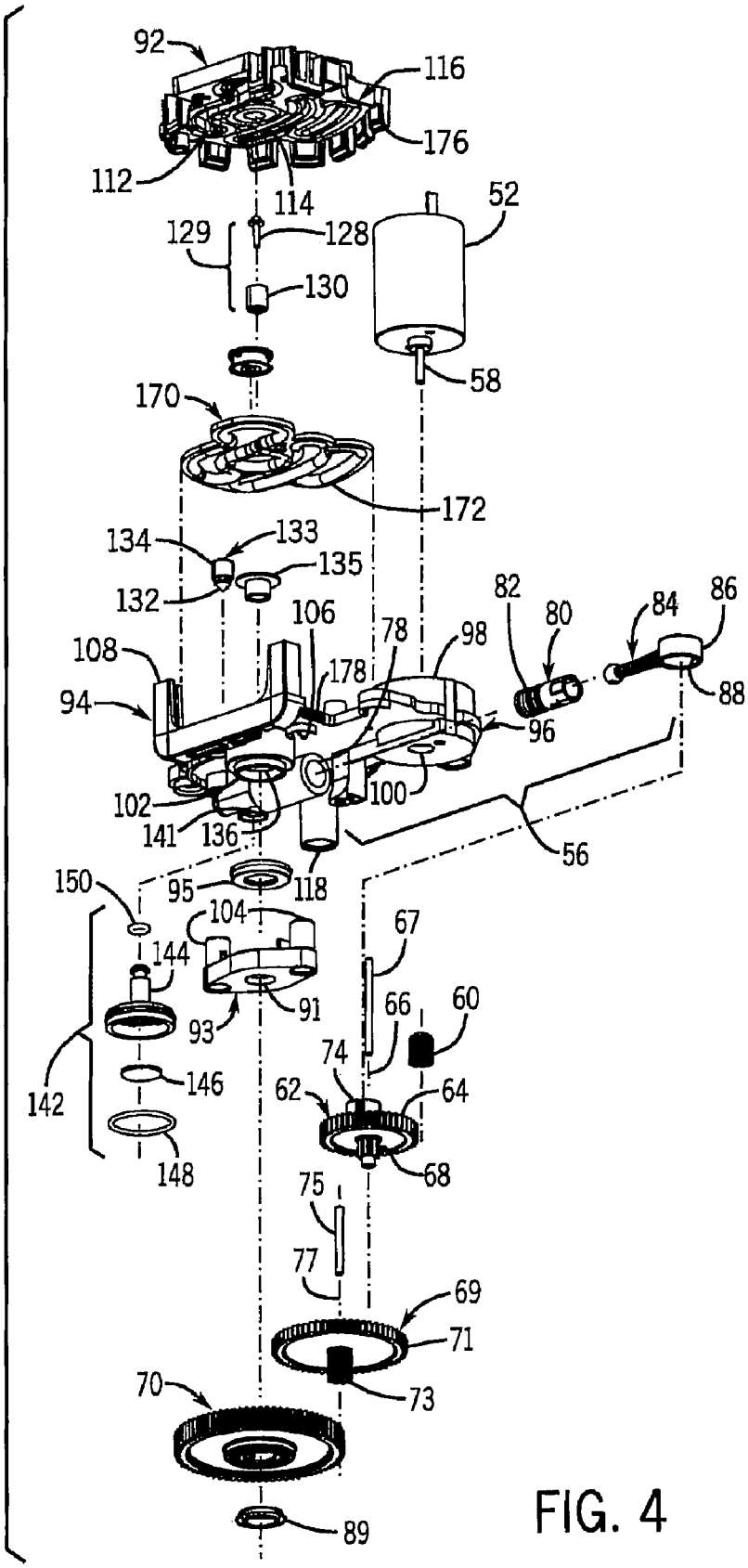
FIG. 4 is a further exploded view of a portion thereof.

Turning now to FIGS. 3, 4 and 8, the lower sprayer body 46 includes a compartment 48 sized to house a power supply 50 (e.g., batteries) for powering a motor 52. A cover 54 releasably secures the power supply 50 in the compartment 48 and prevents water or other fluid from entering the compartment 48. The motor 52 is preferably a direct current electric motor capable of operating on standard AA or AAA batteries.

A gear train is housed within the sprayer body 14 to both rotate the turret 38 and to drive a pump 56 (best shown in FIGS. 4 and 8). The motor 52 includes a drive shaft 58 coupled to a drive gear 60. A pump gear 62 is adjacent the drive gear 60 and includes drive gear teeth 64 that engage the drive gear 60. The pump gear 62 further defines a pump gear axis 66 about which the pump gear 62 rotates on a pin 67.

The pump gear 62 includes intermediate gear teeth 68 that engage and drive an intermediate gear 69 that in turn drives a turret gear 70. The intermediate gear 69 includes pump gear teeth 71 that engage the intermediate gear teeth 68 of the pump gear 62, and turret gear teeth 73 that engage and drive the turret gear 70. The intermediate gear 69 rotates about a second pin 75 defining an intermediate gear axis 77.

The turret gear 70 engages the turret post 72 and coupled nozzle 36 to rotate the turret 38 during operation. The turret post 72 has a pair of arms 79 that engage mating arms 81 formed in the turret 38. The turret post 72 also includes a central opening 83 for receiving the nozzle 36 at a nozzle port 85. The turret post 72 is in fluid communication with the manifold 12. The turret post 72 extends partially into the lower sprayer body 46 through an opening 87. A lower valve seal 89 is sandwiched between the lower sprayer body 46 and the turret gear 70. The turret post 72 continues to extend through an opening 91 in a seal holder 93 and engages an upper valve seal 95 adjacent the manifold 12.

Returning to the pump gear 62, the pump gear 62 includes a lobed portion 74 (shown in FIG. 8 in cross-section) generally offset from the gear axis 66. As the pump gear 62 rotates about the gear axis 66, the lobed portion 74 communicates with a pump 56.

Specifically, the pump 56 includes a pump chamber 78 in which a piston 80 rides. The pump chamber 78 is preferably integrally molded into a second housing part 94, but may be formed integral to a first housing part 92, or a combination of the first housing part 92 and the second housing part 94 (described below).

A seal 82 prevents fluid 34 from leaking around the piston 80 during operation. A connecting rod 84 is pivotally coupled to the piston 80 at one end and includes a bearing 86 at the opposite end. The lobed portion 74 of the pump gear 62 rides along an interior surface 88 of the bearing 86 to alter the rotational movement of the pump gear 62 about the gear axis 66 to essentially linear movement of the piston 80 within the pump chamber 78. The movement of the piston 80 draws in and expels fluid 34 from the pump chamber 78 (described below). The pump 56, drive gear 60, pump gear 62, intermediate gear 69, turret gear 70, and other drive/pump components are preferably made of plastic, such as nylon.

Figure 5:
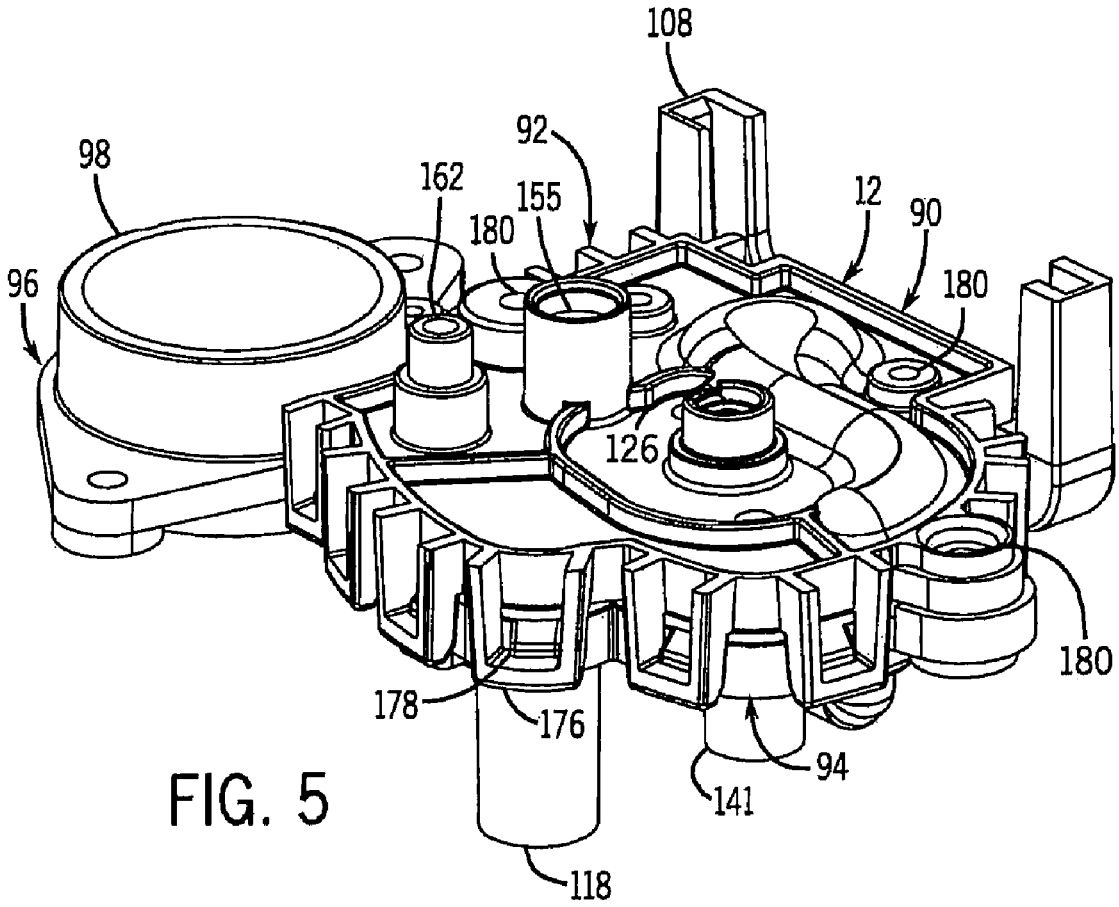
FIG. 5 is a rear upper perspective view of a manifold portion thereof.
Figure 6:
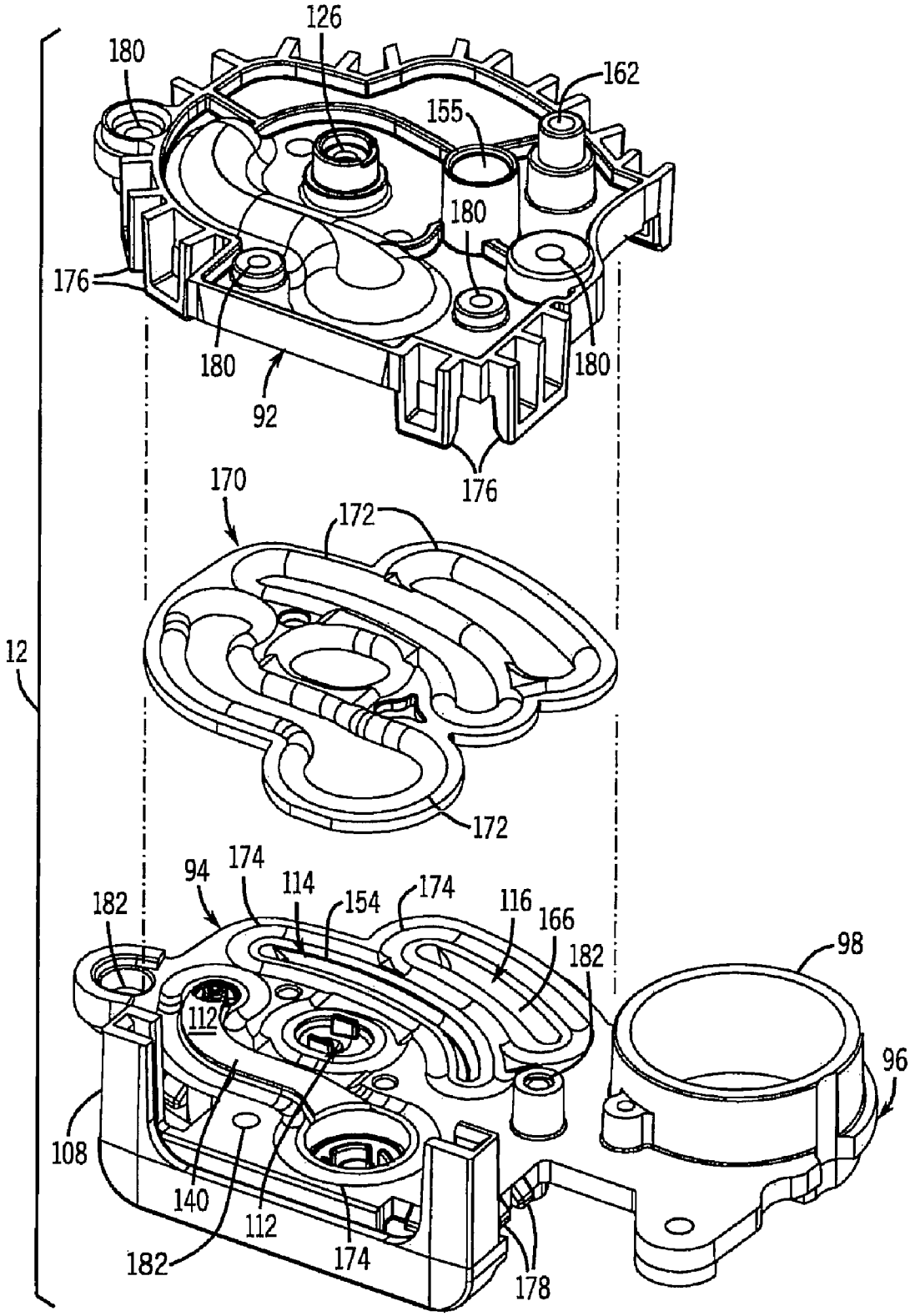
FIG. 6 is a frontal upper perspective view, in exploded form, of the manifold shown in FIG. 5.
Figure 7:
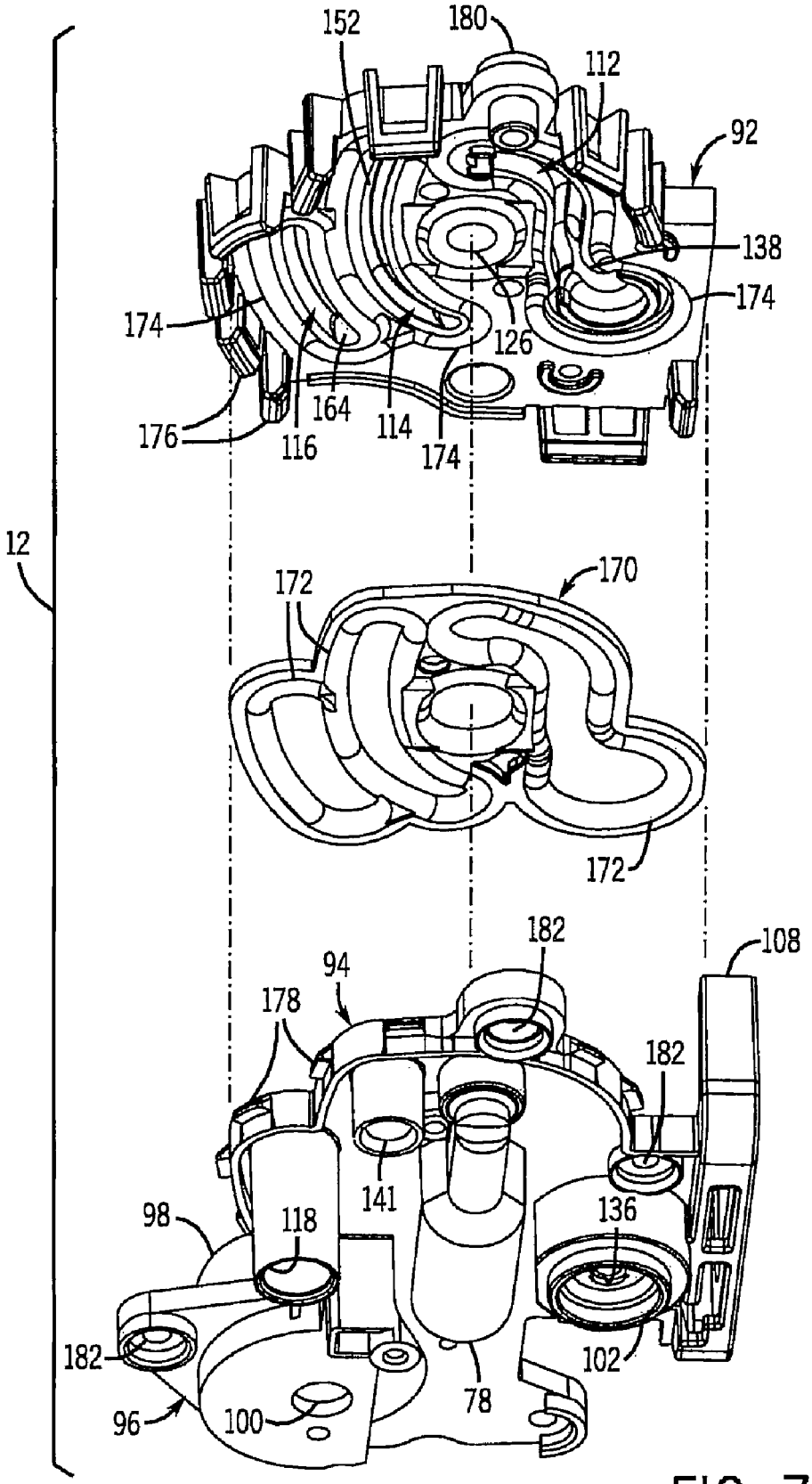
FIG. 7 is a bottom exploded view of the manifold assembly shown in FIG. 5.

With continued reference to FIGS. 4 and 8, and additional reference to FIGS. 5-7, the manifold 12 includes a housing 90 having a first housing part 92 and a second housing part 94. In the preferred example embodiment, the housing 90 is made from two portions that are coupled to form an essentially leak-free seal there between. However, the housing 90 may be a contiguous body having the appropriate passageways formed therein during manufacturing.

For example, depending upon the complexity of the housing 90, the housing 90 may be made by investment casting in which the internal passageways are generally formed during manufacturing. The housing 90 is preferably made of two or more parts to minimize the complexity and manufacturing costs. Additionally, as will be described, several components are secured within the housing 90, thus access to the internal components is beneficial during manufacturing and for replacement/repair purposes.

The second housing part 94 includes an integrally molded pump chamber 78 and motor support 96. The motor support 96 preferably includes a collar 98 sized to receive and stabilize the motor 52. A drive shaft opening 100 is formed in the motor support 96 to allow the drive shaft 58 to extend through and drive the gear train. The motor support 96 may be made in a variety of configurations as required by the motor 52 it is intended to restrain and the required orientation. For example, the motor 52 may be mounted such that the drive shaft 58 is essentially parallel with the pump chamber 78.

The motor support 96 may be configured to support a motor 52 in any number of orientations and configurations that are within the scope of the present invention. Additionally, the motor support 96, while shown as being a portion of the second housing part 94, may be formed as part of the first housing part 92, or may be formed by some combination of the first housing part 92 and the second housing part 94.

A turret collar 102 extends from the second housing part 94 to engage the seal holder 93 that is coupled to the second housing part 94, for example, with fasteners (not shown) that extend partially through the standoffs 104 and into the receiving holes 106. The second housing part 94 further includes a unshaped support 108 that receives a controller 110 that monitors the buttons 40 and activates the automated sprayer 10.

The housing 90 includes several passageways that direct fluid 34 between various portions of the automated sprayer 10. A first passageway 112 directs fluid 34 from the fluid reservoir 30, through the housing 90, and ultimately to the nozzle 36 where it is expelled into the ambient environment before reaching the surrounding enclosure surfaces (not shown). As the fluid 34 is removed from the fluid reservoir 30, the second passageway 114 allows ambient air to travel from the ambient environment, through the housing 90, and into the fluid reservoir 30, thus preventing a vacuum from forming in the fluid reservoir 30. The third passageway 116 provides fluid communication between the well 28 and a drain outlet 118 to allow excess fluid 34 accumulated in the well 28 during a fluid reservoir 30 change to be expelled from the well 28 to the ambient environment.

With respect to the first passageway 112, seating the fluid reservoir 30 (e.g., bottle) into the well 28 depresses a spring-loaded check valve 120 in the reservoir interface assembly 33 that allows the fluid 34 to flow through the piercing post 32 at a fluid inlet 122. The reservoir interface assembly 33 is preferably coupled to the upper sprayer body 44 via receiving holes 35 formed in the upper sprayer body 44 and screws (not shown), best shown in FIG. 8.

The fluid 34 flows past the check valve 120 and though a fluid chamber 124 formed in the upper sprayer body 44. The fluid 34 continues to the fluid inlet port 126 of the first passageway 112 that is formed in the first housing part 92. A first pump check valve 129 includes a first pump valve needle 128 and a first pump valve case 130 that allows the fluid 34 to only flow downstream of the fluid reservoir 30.

The fluid 34 is drawn into the first passageway 112 as the piston 80 is partially withdrawn from the pump chamber 78. As the motor 52 continues to rotate the drive shaft 58, the piston 80 then reduces the available volume in the pump chamber 78 causing the fluid 34 to be expelled downstream through the first passageway 112 due to the first pump valve needle 128 preventing the fluid 34 from flowing upstream back into the fluid reservoir 30.

The fluid 34 is directed through the first passageway 112 formed in the second housing part 94 past a second pump check valve 133 having a second pump valve needle 132 and a second pump valve case 134. The fluid 34 is then directed by the pressure differential created by the pump 56 through the first passageway 112 to a filter assembly 135 and then to a fluid outlet port 136. The fluid outlet port 136 is coupled to the turret post 72. The fluid 34 is directed through the central opening 83 and then is expelled from the nozzle 36.

The first passageway 112 includes a first channel 138 formed in the first housing part 92 and a mating second channel 140 formed in the second housing part 94. Optionally, the first passageway 112 may be all in one housing part. Coupling the first housing part 92 and the second housing part 94 essentially aligns the first channel 138 and the second channel 140, thereby defining a portion of the first passageway 112. The first passageway 112 is preferably sized to allow a sufficient amount of fluid 34 to flow from the fluid reservoir 30 through the passageway 112 and out the nozzle 36.

With respect to the second passageway 114, as fluid 34 is withdrawn from the fluid reservoir 30, ambient air is drawn through the second passageway 114 and into the fluid reservoir 30. A vent valve assembly 142 (best shown in FIG. 4) includes a vent valve 144, a diaphragm 146, a lower o-ring 148, and an upper o-ring 150. The vent valve assembly 142 allows ambient air to enter an air inlet port 141 formed in the second housing part 94 and travel through the second passageway 114 into the fluid reservoir 30.

Specifically, the first housing part 92 includes a third channel 152 formed therein and the second housing part 94 includes a fourth channel 154 integrally formed therein. Again, coupling the first housing part 92 and the second housing part 94 aligns the third channel 152 and the fourth channel 154 to define a portion of the second passageway 114. Ambient air is drawn in the air inlet port 141 and directed through the second passageway 114 to an air outlet port 155 protruding from the first housing part 92. The ambient air is then directed through an air chamber 156 formed in the upper sprayer body 44 where it can be expelled into the fluid reservoir 30 via air outlet 158 formed in the piercing post 32. Thus, the appropriate amount of ambient air is directed into the fluid reservoir 30 as fluid 34 is expelled from the automated sprayer 10.

With respect to the third passageway 116, when replacing a nearly empty fluid reservoir 30, a small amount of fluid 34 may initially pool in the well 28; however, the third passageway 116 provides a fluid 34 passage between the well 28 and the ambient environment to allow this excess fluid 34 to drain. A drain chamber 160 is formed in the upper sprayer body 44 and leads to a drain inlet 162 that protrudes from the first housing part 92. The drain inlet 162 leads to the third passageway 116 that is integrally formed in the first housing part 92 and the second housing part 94 by a fifth channel 164 formed in the first housing part 92 and a mating sixth channel 166 formed in the second housing part 94.

As with the first passageway 112 and the second passageway 114, coupling the first housing part 92 and the second housing part 94 essentially aligns the fifth channel 164 and the sixth channel 166, thereby defining a portion of the third passageway 116. The excess fluid 34 is directed through the third passageway 116 downstream to the drain outlet 118 that protrudes from the second housing part 94 where it is expelled from the automated sprayer 10 through a drain hole (not shown) formed in the lower sprayer body 46 to the ambient environment.

The ancillary components of the manifold 12 may be formed integrally with the first housing part 92 and/or the second housing part 94. For example, the first housing part 92 may be directly coupled to the reservoir interface assembly 33, or alternatively, the reservoir interface assembly 33 may be formed integrally with the first housing part 92.

A gasket 170 is seated between the first housing part 92 and the second housing part 94 to prevent fluid 34 from leaking when the first housing part 92 and the second housing part 94 are coupled. The gasket 170 includes a plurality of beads 172 that seat in mating grooves 174 formed in the first housing part 92 and the second housing part 94 about the perimeter of the first passageway 112, second passageway 114, and third passageway 116.

With specific reference to FIG. 8, the gasket 170 is shown compressed between the first housing part 92 and the second housing part 94. The beads 172 of the gasket 170 are shown seated in the grooves 174, thus providing a seal between the various passageways 112, 114, 116. Additionally, a seal is formed in the gasket 170 proximate the fluid inlet port 126 of the first passageway 112, again to prevent leakage as the fluid 34 flows through the automated sprayer 10. The gasket 170 is preferably made of an elastomeric material or other resilient material, such as, rubber and plastic, which are chemically resistant to the fluid 34 cleanser used in the automated sprayer 10.

The first housing part 92 and the second housing part 94 are preferably coupled by a series of resilient clips 176 and tabs 178 (shown most clearly in FIG. 5). In the preferred embodiment, the clips 176 are integrally formed with the first housing part 92 and the tabs are integrally formed with the second housing part 94. As the first housing part 92 and the second housing part 94 are mated, the resilient clips 176 deflect as they ride up the tabs 178 and spring back to releasably engage the tabs 178.

It is contemplated that the clips 176 and tabs 178 may be on either of the first housing part 92 and the second housing part 94, or both. Additionally, a series of self-tapping screws (not shown) are preferably used to clamp the first housing part 92 and second housing part 94. The screws extend through a plurality of mounting holes 180 formed through the first housing part 92 and self-thread into a plurality of receiving holes 182 formed in the second housing part 94. Again, the number, location, and orientation of the screws, mounting holes 180, and receiving holes 182 may be altered to various locations and configurations that remain within the scope of the present invention.

Figure 9:
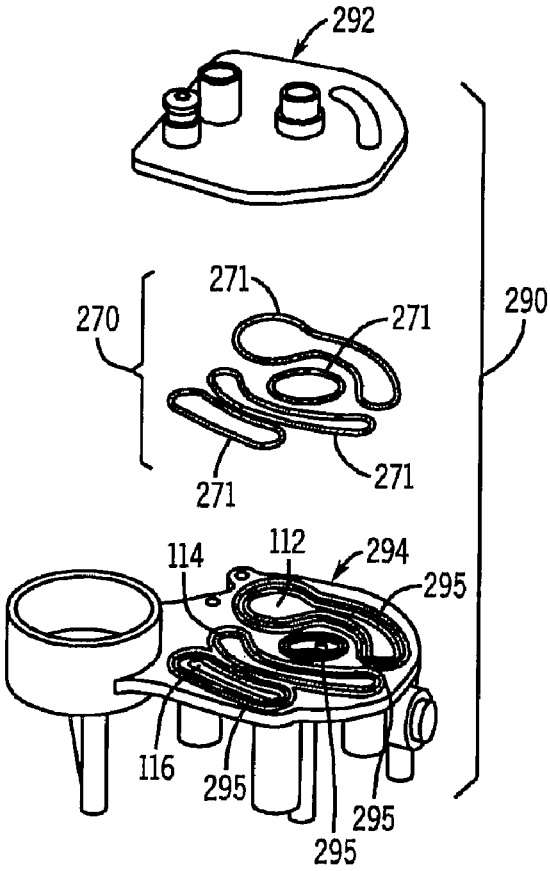
FIG. 9 is an exploded view of an alternative manifold.
Figure 10:
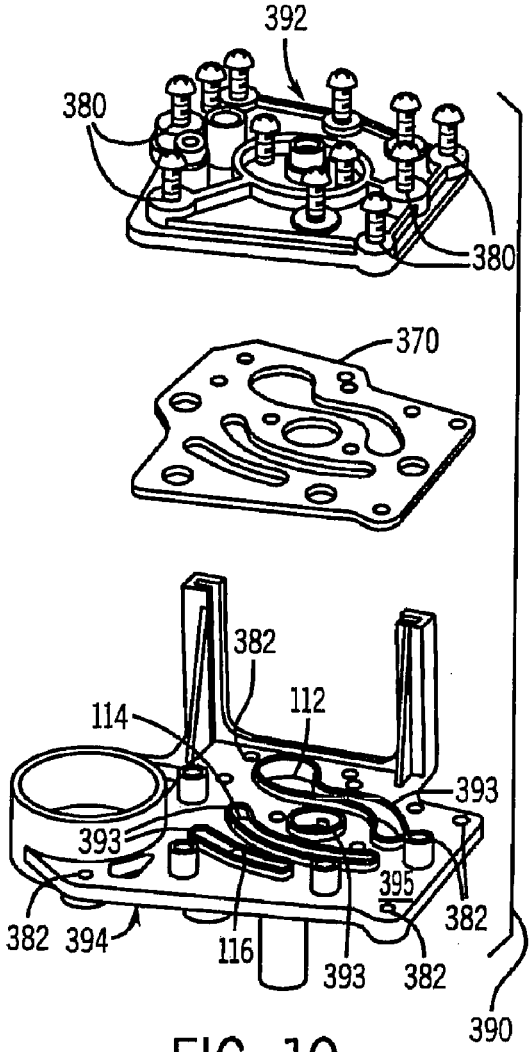
FIG. 10 is an exploded view of another alternative manifold.

Turning to FIGS. 9 and 10, two alternative constructions for sealing and coupling the manifold 12 are shown. With reference to FIG. 9, a first alternative housing 290 is shown having a first housing part 292 and a second housing part 294. The housing 290 includes a first passageway 112, a second passageway 114, and a third passageway 116, similar to the previous embodiment. However, the first housing part 292 and the second housing part 294 include recesses 295 that receive a gasket 270.

The gasket 270 comprises a series of metal welding parts 271 that seat in the recesses 295. To form the housing 290, the first housing part 292 and the second housing part 294 are coupled by mating the first housing part 292 and second housing part 294. Next, the housing 290 is subjected to induction welding during which the metal welding parts 271 are heated causing the first housing part 292 and second housing part 294 to meld together forming a seal between the various passageways 112, 114, 116. The metal welding parts 271 are preferably made of.

The first housing part 292 and the second housing part 294 are preferably made of a thermoplastic that can be heated to its flow temperature to create a bond between the first housing part 292 and the second housing part 294. The housing 290 is preferably made of. Alternatively, the metal welding parts 271 may be excluded and the first housing part 292 and the second housing part 294 can be ultrasonically welded along the desired seals to join the first housing part 292 and the second housing part 294.

With reference to FIG. 10, a second alternative housing 390 is shown having a first housing part 392 and a second housing part 394. The housing 390 includes a first passageway 112, a second passageway 114, and a third passageway 116, similar to the two previous embodiments. However, the second housing part 394 includes ridges 393 that extend essentially perpendicular from the interface surface 395 of the second housing part 394 about the perimeter of the first passageway 112, second passageway 114, and third passageway 116. A gasket 370, having a thickness greater than the height of the ridges 393, is compressed between the first housing part 392 and the second housing part 394.

Again, a series of mounting holes 380 and receiving holes 382 are formed in the first housing part 392 and the second housing part 394. Alternatively, the first housing part 392 and second housing part 394 may be coupled by a combination of resilient clips and tabs (not shown), or some combination thereof. The first housing part 392 and the second housing part 394 are preferably made of plastic that is resistant to the chemicals used in the automated sprayer 10, such as.

Preferred embodiments of the invention have been described in considerable detail. Many modifications and variations to the preferred embodiments will be apparent to those skilled in the art, which will be within the spirit and scope of the invention.

For example, rather than the gasket being in four parts as shown in FIG. 9, or one part as shown in FIG. 7, it could be in two parts. Further, the cross sectional shape of the gasket area on the right hand side of the FIG. 7 assembly could be o-ring shaped, and the cross sectional shape of the gasket area on the left side of the gasket of FIG. 7 could be elliptical shaped. This can reduce the compressive forces needed to achieve a good seal.

In another alternative the container used with such a device could be of the collapsible type which does not need to be vented. In such a case air vent passageways through the manifold would not be needed.

Therefore, the invention should not be limited to the described embodiments. To ascertain the full scope of the invention, reference should be made to the claims.

INDUSTRIAL APPLICABILITY

The invention provides a manifold for accommodating various functions of an automated sprayer.

What is claimed is:

1. A manifold assembly suitable to be mounted within an outer body of an automated sprayer, the automated sprayer being configured to deliver cleaning fluid from a reservoir to a spray nozzle, the manifold assembly comprising:

a housing positionable within the outer body of the automated sprayer and having a cleaning fluid inlet passage, a cleaning fluid outlet passage, a cleaning fluid passageway therebetween, and a motor supported by the housing and being suitable to be operatively linked to a pump; and a pump mounted in the manifold assembly linked to both the cleaning fluid inlet passage and cleaning fluid outlet passage;

wherein the housing also has a stand for supporting the motor;

wherein the manifold assembly further comprises an air inlet, an air outlet, and an air passageway therebetween;

wherein the manifold assembly further comprises a drainage passageway for carrying drainage fluid through the manifold assembly without passing through the cleaning fluid inlet passage or cleaning fluid outlet passage;

wherein the housing comprises a first housing part and a second housing part that have been coupled together, with an elastomeric gasket sandwiched between the first housing part and the second housing part, the gasket being positioned so as to:

(i) define a perimeter portion of the cleaning fluid passageway;

(ii) define a perimeter portion of the air passageway; and (iii) define a perimeter portion of the drainage passageway;

while also sealing the fluid passageway from the air passageway and also from the drainage passageway;

wherein the elastomeric gasket is seated against the housing at a coupling between the first and second housing parts.

2. The manifold assembly of claim 1, wherein the pump is operatively linked to the motor.

3. The manifold assembly of claim 2, further comprising a check valve positioned in the manifold assembly.

4. The manifold assembly of claim 1, wherein there is a pump chamber integrally formed in at least one of the first housing part and the second housing part.

* * * * *